US008376055B2

(12) United States Patent
Chambers, II et al.

(10) Patent No.: US 8,376,055 B2
(45) **Date of Patent: *Feb. 19, 2013**

(54) SHEARING TOOL AND METHODS OF USE

(76) Inventors: James Edward Chambers, II, Magnolia, TX (US); Gerald Robert Byrd, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/136,035

(22) Filed: Jul. 21, 2011

(65) Prior Publication Data

US 2011/0278020 A1 Nov. 17, 2011

Related U.S. Application Data

(63) Continuation of application No. 12/378,383, filed on Feb. 13, 2009, now Pat. No. 8,006,769.

(51) Int. Cl.
*E21B 41/00* (2006.01)
*E21B 29/00* (2006.01)
*E21B 23/00* (2006.01)

(52) U.S. Cl. ..... 166/381; 166/113; 166/173; 166/170

(58) Field of Classification Search ..... 166/173, 166/170, 81.1, 377; 15/88
See application file for complete search history.

(56) References Cited

U.S. PATENT DOCUMENTS 8,006,769 B2 * 8/2011 Chambers et al. ..... 166/377

* cited by examiner

*Primary Examiner* — Thomas Beach
*Assistant Examiner* — James Sayre
(74) *Attorney, Agent, or Firm* — The Matthews Firm

(57) ABSTRACT

A shearing tool for shearing, trimming, or reducing objects being pulled through a drill string and methods for retrieving retrievable tools with fins from the drill string, where the retrievable tools must pass through restrictions in the drill string having interior diameters less than the outer diameters of the fins. The fins, affixed to the retrievable tools, provide stability to the tools, while within the drill string, and can be made of rubber, plastic, other shearable materials, or combinations thereof. The apparatuses and methods include inserting a shearing tool with a flange into a box end of a section of drill string, where the flange keeps the shearing tool in place. The shearing tool further comprising a cutting surface for cutting materials pulled through the shearing tool.

16 Claims, 5 Drawing Sheets

SHEARING TOOL AND METHODS OF USE

CROSS-REFERENCE TO RELATED APPLICATION

The present application is a continuation application, which claims priority to the U.S. patent application having the application Ser. No. 12/378,383, filed Feb. 13, 2009, now U.S. Pat. No. 8,006,769 the entirety of which is incorporated herein by reference.

FIELD

The present invention relates generally to shearing tools and methods of shearing, trimming, or reducing materials on downhole tools for retrieving the downhole tools from within a drill string and to the surface.

BACKGROUND

Drilling operations, and especially directional drilling operations, often utilize one or more tools for determining the position of a drill bit and for directing the drilling force of the drill bit. These tools are often placed within the drill string, near the drill bit, e.g., near or within a drill collar or a sub in the bottom hole assembly. To operate, these tools require a stable and secure fit within the drill string. To centralize and/or stabilize such tools within a tubular string, blades, fins, or similar protruding members can be affixed to the exterior of such tools. These fins are frequently made from materials used to dampen the shock and vibrations common near the bottom hole assembly, such as rubber, hard plastics, and/or similar pliable materials.

When these downhole tools are damaged or otherwise cease to function properly, or when the drill string becomes stuck in the wellbore, the downhole tools must be retrieved, e.g., through use of a wireline to pull the downhole tools to the surface. The fins or other protrusions affixed to the tools, which normally assist in the operation and stability of the tools, can become obstacles in removing the tools from the drill string, as these fins must often pass through restrictions in the drill string during the retrieval operation. Frequently, these fins provide the tool with a greater diameter than that of one or more restrictions within the drill string, hindering removal of the tool, or rendering the removal impossible.

Therefore, a need exists for apparatuses that can be placed within a drill string, or on a tool itself, for the purpose of shearing, trimming, and/or reducing fins or similar objects from downhole tools, with great stability and accuracy, to allow the tools to freely pass through restrictions in the drill string and, thus, be retrieved to the surface.

In addition, a need exists for methods for shearing, trimming, and/or otherwise reducing objects in a drill string, including materials such as fins on the body of objects, to allow the objects to pass through restrictions in the drill string, thus enabling retrieval thereof.

Further, a need exists for apparatuses and methods for shearing, trimming, and/or reducing the diameter of multiple retrievable tools, as these tools are removed from a drill string and retrieved to the surface.

The present embodiments meet these needs.

SUMMARY

Embodiments of the present invention relate generally to shearing tools and methods for retrieving downhole tools used within drill strings. Specific embodiments include shearing tools and methods for shearing, trimming, and/or reducing materials on downhole tools, such as stabilizing or centralizing fins protruding from the downhole tools, to enable the retrieval of the downhole tools through restrictions in the drill string and to the surface.

In an embodiment, a shearing tool can include a body having a channel. A first end of the body can include a flange usable to secure and/or lock the body in the drill string, e.g., by abutting the flange between the threaded connection of two adjacent segments of drill pipe. A second end of the tool can have a cutting surface thereon. A plurality of spacers can be mounted on the exterior of the body for centralizing the body in the drill string, such that when objects are pulled through the channel, one or more fins or similar protrusions extending from the objects can be sheared, trimmed, and/or otherwise reduced by the cutting surface. Typically, the fins or protrusions can be made from rubber, plastic, or other pliable and/or shearable materials to facilitate shearing of the fins. The cutting surface can be located within the channel, at the second end of the body of the searing tool, or elsewhere along and/or within the tool.

In an embodiment, the shearing tool can be inserted into a drill string having a first section with a box end, a second section with a pin end, and a flow path therethrough. The first end of the shearing tool can engage the box end, and the second end of the shearing tool can protrude into the flow path of the drill string for shearing materials that pass therethrough, such as fins or similar protrusions extending from downhole tools. The shearing of the fins or similar protruding material on the tools can occur as the tools are pulled through the channel of the shearing tool, thereby contacting the protrusions of the downhole tool with the cutting surface of the shearing tool.

Embodiments of the invention can also include methods for removing a retrievable downhole tool having materials, such as centralizing or stabilizing fins, from a drill string. Embodiments can include inserting a retrievable tool into a drill string, inserting a shearing tool into the drill string, e.g., located in an uphole direction from the retrievable tool, pulling the retrievable tool through the shearing tool, thereby shearing the fins on the retrievable tool with the shearing tool, and pulling the trimmed retrievable tool through a restriction or other area of reduced diameter in the drill string and to the surface.

Embodied methods can further include inserting the shearing tool into a box end of a first section of the drill string so that a flange extending from the shearing tool rests in the interior of the box end while a portion of the shearing tool protrudes into a flow path of the drill string. For example, a retrievable tool having fins can be placed in a drill string in a downhole direction relative to a shearing tool, while a restriction in the interior diameter of the drill string can be disposed in an uphole direction relative to the shearing tool. Shearing the fins of the retrievable tool as it passes through the shearing tool can enable the retrievable tool to pass through a restriction through which passage would otherwise have been prevented by the fins.

BRIEF DESCRIPTION OF THE DRAWINGS

In the detailed description of the embodiments presented below, reference is made to the accompanying drawings, in which.

Figure 1A:
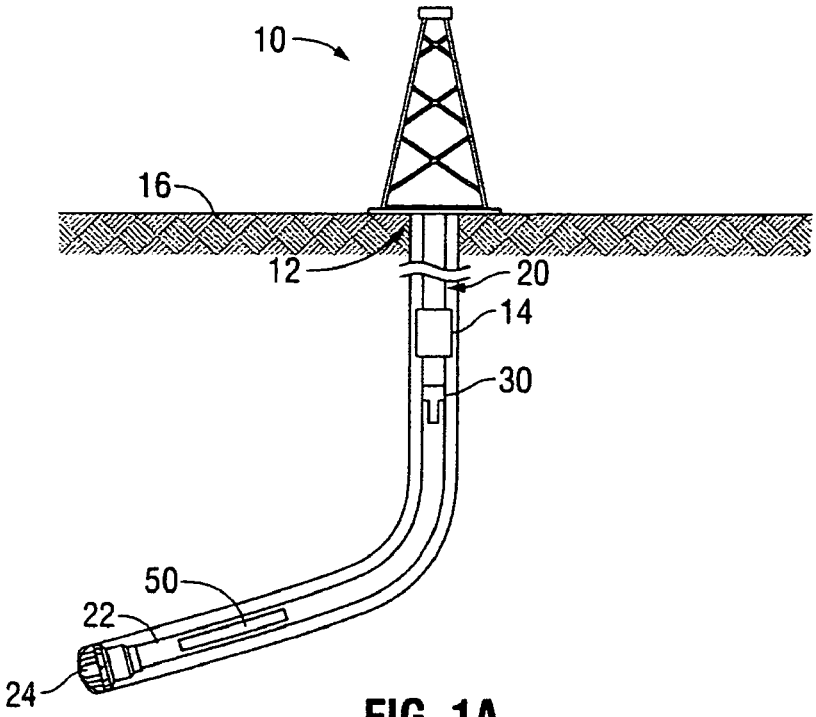
FIG. 1A depicts a side view of a drilling rig with a retrievable tool located downhole in accordance with an embodiment of the present invention.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION

Before explaining the present embodiments in detail, it is to be understood that the embodiments are not limited to the particular descriptions and that the embodiments can be practiced or carried out in various ways.

Embodiments of the present invention relate generally to shearing tools and methods for retrieving downhole tools useable within drill strings, such as measurement-while-drilling (MWD) tools, steering tools, and EM pulse tools. More specifically, embodiments of the present invention relate to shearing tools and methods for shearing, trimming, and/or reducing stabilizing or centralizing fins located on retrievable tools, to enable the retrieval of the downhole tools through restrictions in the drill string.

In an embodiment, a shearing apparatus can be placed in a drill string for the purpose of shearing, trimming, and/or reducing materials from the body of a downhole tool, with great accuracy and stability, so that the body of the downhole tool can pass through restrictions in the drill string as tools are retrieved to the surface. For example, a measurement-while-drilling (MWD) tool can be made to fit securely into a drilling string using fins or similar protruding members, which are affixed to the outer surface of the MWD tool. If the MWD tool must be retrieved to the surface, a shearing apparatus can be placed in the drill string for shearing or trimming the fins on the tool as it passes through the channel of the shearing apparatus. Shearing of the fins in this manner enables the MWD tool to pass through relatively small drill string restrictions between the shearing tool and the surface, generally unimpeded by the fins, which otherwise would have presented an obstacle to removal of the tool.

By way of example, MWD tools, such as gyroscopes, accelerometers, magnetometers and other instruments, are placed in the drill string to provide a number of real-time downhole measurements, including detection of the real-time position and direction of a drill bit. In addition to positional data, MWD tools can provide measurements relating to the drill bit and drilling conditions, such as rotational speed of the drill string, smoothness of rotation, type and severity of downhole vibration, downhole temperature, torque and weight on or near the drill bit, and mud flow volume. To accurately measure both positional data and other data relating to the drill bit, the MWD tools must be located near or adjacent to the drill bit, such as within a drill collar. While positioning a MWD tool in such a location is desirable for obtaining accurate measurements, such tools are exposed to harsh, hot, highly pressured, dirty, and high shock-load environments. Therefore, MWD tool failures are not uncommon, and retrieval and replacement of a MWD tool is often necessary. Additionally, in the event that the drill pipe becomes stuck in the wellbore, any MWD tools within the drill pipe may be permanently lost. In these and other circumstances, it is desirable to retrieve the MWD tools to the surface, e.g., through use of a wire line or similar methods.

To improve the stability of MWD tools while within the drill string, rubber fins or similar members have been affixed to MWD tools and used to centralize and stabilize the tools. Use of rubber fins or other members in this manner (e.g., placed around the circumference of a MWD tool), increases the effective outer diameter of the tool to provide a secure and stable fit within the drill string, which provides a cushioning effect to reduce the shock and vibration caused by drilling operations. However, use of fins or similar protruding members can create difficulty when it is desired to retrieve MWD tools through the drill string, and the tool's largest outer diameter meets or exceeds the inner diameter of one or more drill string restrictions located in an uphole direction from the tool. In most circumstances, such a MWD tool cannot pass through the drill string restriction and thus, cannot be retrieved. In certain circumstances, the fins or protrusions used to centralize and stabilize retrievable MWD tools can provide the tools with a smaller effective diameter, selected such that the tools and fins will pass through the narrowest restriction in a drill pipe. However, this method results in a less secure fit between the retrievable MWD tool and the surrounding MWD receptacle, which hinders the effectiveness of the fins and of the tool itself. Although smaller fins provide some benefit, the lack of a firmly fixed and secure fit permits the effects of downhole shock and vibration on the MWD tool to be amplified and can prevent certain operations of the tool.

Therefore, tools and methods for shearing, trimming, and/or reducing the fins affixed to retrievable downhole tools, such as MWD tools, permit operators to use downhole tools with fins that can be firmly fitted and secured within the drill string, while enabling the retrieval of these downhole tools to the surface, through drill string restrictions having diameters less than the effective diameter of the tools.

Provision of a shearing apparatus within a drill string can enable shearing, trimming, and/or reducing of multiple retrievable downhole tools as the tools are removed through the drill string, should more than one retrievable tool require removal. For example, steering tools for directing a drill bit during directional drilling operations, and EM pulse tools for transmitting data to the surface, also often require stabilization using fins or similar protrusions, which can impede retrieval of the tools. Therefore, it is often necessary to firmly stabilize multiple tools within a drill string, and retrieve multiple tools through a restriction in the drill string.

FIG. 1A depicts a drilling rig 10 for drilling and operating a borehole or wellbore 12 in a surface 16 (e.g., the ground). A drill string 20 is shown within the borehole 12, having a drill collar 22 adjacent to a drill bit 24. A retrievable downhole tool 50 (e.g., a measurement while drilling tool) is shown in or near the drill collar 22. The measurement while drilling (MWD) tool shown in FIG. 1A serves as an illustrative example of a tool usable within the scope of the present disclosure. It should be understood that any retrievable downhole tool, including without limitation, steering tools, EM pulse tools, and other similar tools having centralizing and/or stabilizing fins or protrusions attached, can be used within one or more embodiments. Further, retrievable downhole tools usable within the scope of the present disclosure can be located at any desired position within the drill string 20 (e.g., within a sub). The retrievable downhole tool 50 can include centralizing or stabilizing fins can be made of such materials as rubber, plastic, other pliable or shearable materials, or combinations thereof. The drill string 20 is shown having a jar 14 and a shearing tool 30 positioned therein. FIG. 1 depicts the shearing tool 30 between the drill collar 22 and the jar 14. It should be appreciated that if the retrievable tool 50 is located elsewhere within the drill string 20, the shearing tool 30 can be placed at any desired location between the retrievable tool 50 and the jar 14 or other restriction within the drill string 20. It should also be noted that while typically, the outer diameter of the jar 14 is limited by the inner diameter of the casing lining the borehole 12. Coupled with limitations on the outer diameter of a jar, the radial space required by the jar often results in a reduced inner diameter of the drill string, due to the mechanical components required to handle the force used by the jar to physically jar a drill string loose in a borehole, coupled with the limitations on the jar's 14 outer diameter.

Restrictions in drill strings, such as the jar 14, can limit the effectiveness and/or use of rubber fins on retrievable tools by limiting the size of the fins such that the diameter of the retrievable tool 50 will pass through the jar 14 and/or other restrictions in the drill string 20. Generally, fins and/or other protrusions large enough to enable the retrievable tool 50 to be securely stabilized within the drill string 20 would provide the tool 50 with a diameter that exceeds the inner diameter of the jar 14 or other restriction. As described previously, use of fins that do not enable the retrievable tool 50 to fit securely and firmly within the drill string 20 can hinder or prevent certain operations of the tool 50.

The borehole 12 is illustrated as a directional borehole, which can be formed by means known to those of ordinary skill in the art; however, it should be understood that embodiments described within the present disclosure are usable with any type of borehole, within which a retrievable tool is located in any desired position. Embodiments can include, generally, providing a shearing tool between a retrievable tool and a restriction in the inner diameter of the drill string through which the retrievable tool may not easily pass.

Figure 1B:
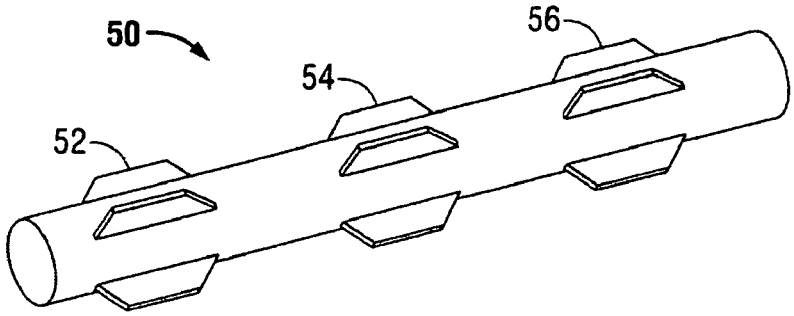
FIG. 1B depicts a perspective view of a retrievable tool having fins in accordance with an embodiment of the present invention.

FIG. 1B illustrates the exterior of an embodiment of a retrievable tool 50. The retrievable tool 50 is shown having a first set of fins 52, a second set of fins 54, and a third set of fins 56. The retrievable tool(s) 50 contemplated for use with embodiments of the present invention can range from a few feet to about 10 yards in length or more. The exact number of fins, and their location on the tool can vary and can be dictated by the nature of the tool and the total length of the tool. Therefore, a retrievable tool 50 can have fewer than three sets of fins, or more than three sets of fins, as required. Unlike prior art retrievable tools, the fins illustrated on the retrievable tool 50 are configured for a secure and firm fit of the tool within the drill string 20, near or in the drill collar 22 or another section of drill string 20. Appropriate sizing and configuration of the fins can ensure that the retrievable tool 50 is firmly secured within the drill string 20.

In one embodiment, the fins (52, 54, and 56) can be constructed from rubber, a hard plastic, other soft or pliable materials, or combinations thereof, in order to centralize the retrievable tool 50 and to stabilize the retrievable tool 50 within the drill string 20. Other materials are known in the art for centralizing the retrievable tools 50 in a drill string. Certain embodiments of the present invention prefer the use of materials that can be easily sliced or sheared off the retrievable tool 50, such as rubber or plastic.

Figure 1C:
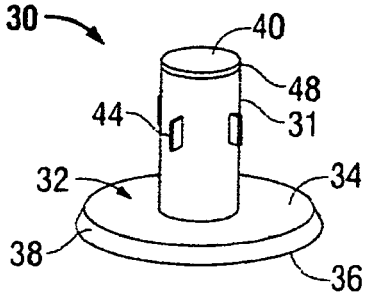
FIG. 1C depicts an elevational view of a shearing tool, usable in an embodiment of the present invention.

FIG. 1C depicts a shearing tool 30 usable with certain embodiments of the present invention. The shearing tool 30 comprises a cylindrical body 31 with a radially extending flange 32 at one end. It should be appreciated that the spirit of the invention is not limited to a cylindrical body 31. The body 31 of the shearing tool 30 need only have a shape and size able to reside in the drill string 20 (See FIG. 1). The radially extending flange 32 has a first surface 34 in its top and a second surface 36 on its bottom with an inward taper 38 between the two surfaces. This exact configuration is not required, and the spirit of the invention includes any extension from the body allowing the shearing tool to be secured within the drill string. A channel 40 passes through the center of the cylindrical body 31, and the radially extending flange 32. The end of the cylindrical body 31, opposite the radially extending flange 32, has an inward taper 46 (not shown in FIG. 1C) resulting in a cutting surface 48. Additionally, a plurality of spacers 44, attached to the cylindrical body, serve to keep the shearing tool 30 centralized in the drill string 20.

Figure 2A:
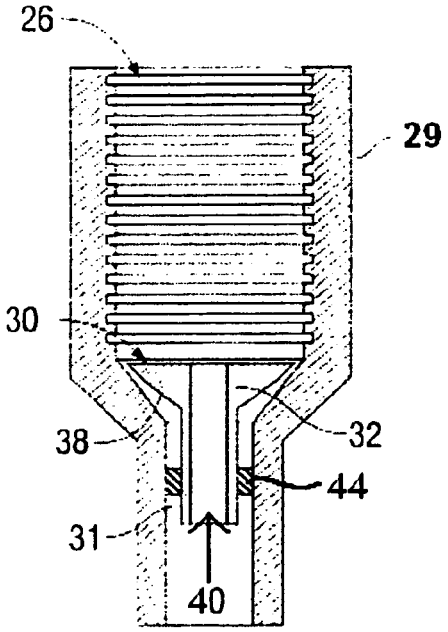
FIG. 2A depicts a cross-sectional view of a shearing tool, placed in the box end of a drill pipe, usable in an embodiment of the invention.

FIG. 2A depicts a shearing tool 30 inserted into the box end 26 of a first drill pipe section or a sub in a drill string. The cylindrical portion 31 of the shearing tool 30 is dimensioned to fit into the inner diameter of the fluid passage in the drill pipe 20, while the radially extending flange 32 is dimensioned to be larger than the inner diameter of the fluid passage and to rest in the bottom of the box end 26. The taper 38 of the flange 32 can be dimensioned to allow the shearing tool 30 to rest as far down in the box end 26 as is practical. The cylindrical portion 31 of the shearing tool 30 is shown having the channel 40 extending therethrough, to permit passage of a retrievable tool through the shearing tool. The spacers 44 are shown attached to the cylindrical portion 31 to centralize the shearing tool 30 within the drill string.

Figure 2B:
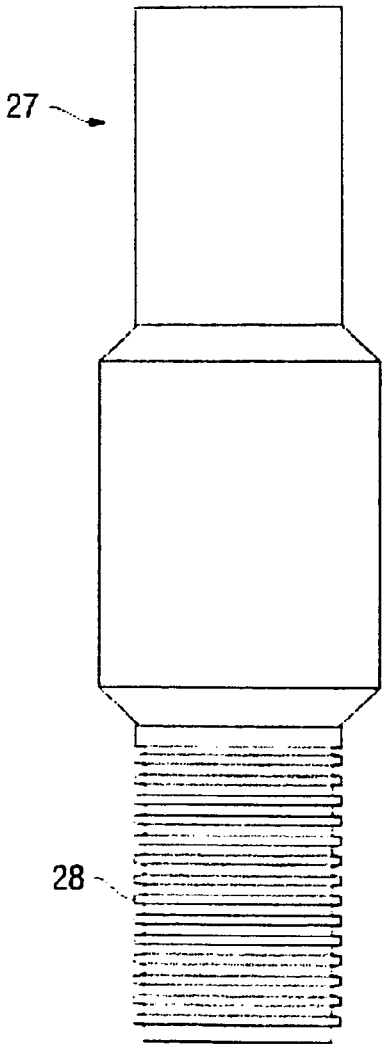
FIG. 2B depicts a cross-sectional view of a pin end of a second section of a drill pipe or sub, usable in an embodiment of the invention.

FIG. 2B depicts a pin end 28 of a second drill pipe section 27 or sub of a drill string 20, which can be stabbed and/or threaded into the box end 26 of a first drill pipe section or sub. The pin end 28 of the second drill pipe section 27 can be stabbed and threaded into the box end 26 (See FIG. 2A) of the first drill pipe section in any conventional manner. The thickness and the taper of the radially extending flange 32 (See FIG. 2A) can be dimensioned to maximize the threaded connection. In one embodiment, the threads of the pin end 28 can be engaged fully with the threads of the box end 26 (See FIG. 2A).

With regard to FIGS. 1A, 1C and 2A, once the first drill pipe section 24 and the second drill pipe section 27 are stabbed, the shearing tool 30 can be firmly locked into position. The second surface 36 on the bottom of the flange 32 of the shearing tool 30 can abut the bottom most surface of the second drill pipe section 27, which has been threaded into place. This contact prevents the shearing tool 30 from moving upwards. The first surface 34, on the top of the flange 32 of the shearing tool 30, as well as the taper 38 of the flange 32, abut the interior portion of the box end 26 of the first drill pipe section 24 and, through this contact, are prevented from moving downhole. In this way, the shearing tool 30 is firmly locked into place in the drill string 20.

Figure 3A:
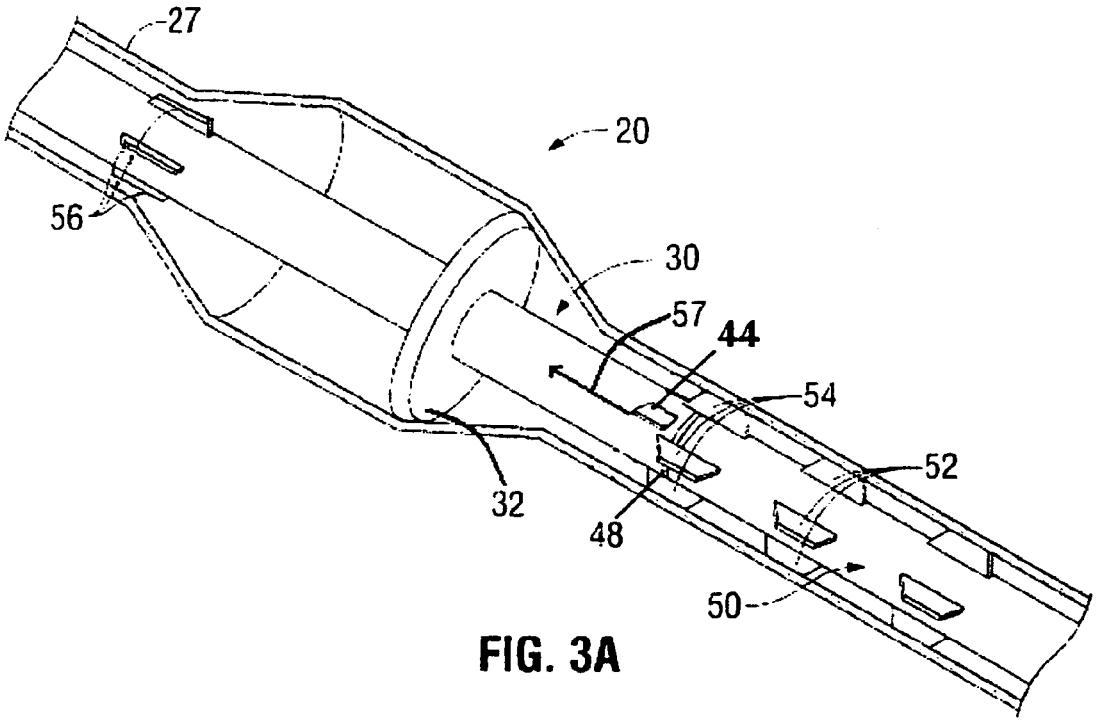
FIG. 3A depicts a perspective view of shearing tool, for shearing or trimming the fins of a retrievable downhole tool placed in a drill string, usable in an embodiment of the present invention.

FIG. 3A depicts the operation of the shearing tool 30 as the retrievable tool 50 is being wire-lined out of the drill string 20. The shearing tool 30 is shown placed at the connection between the first drill pipe section 29 (as shown in FIG. 2A), and the second drill pipe section 27, respectively. The threaded portions of the box and pin ends of each drill pipe section have been omitted from FIG. 3A for clarity, such that the placement of the shearing tool 30 within the drill string 20 is visible. However, it should be understood that the shearing tool 30 is secured against both upward and downhole movement through contact between the flange 32 of the shearing tool 30 and the box and pin ends of the adjacent drill pipe sections, in the manner described previously. The first set of fins 52 on the retrievable tool 50 can be seen to fit securely and firmly within the inner diameter of the drill string 20, as the retrievable tool 50 is being pulled toward the surface in the direction indicated by the arrow 57. The second set of fins 54 can be seen engaged with the cutting surface 48 of the shearing tool 30.

Figure 3B:
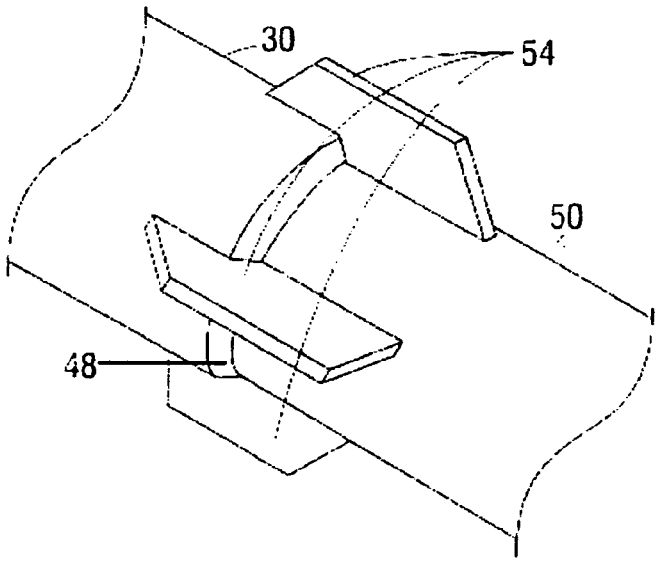
FIG. 3B depicts a perspective view of a retrievable tool comprising sheared or trimmed fins, in accordance with an embodiment of the present invention.

FIG. 3B provides a closer look at the second set of fins 54, having been sheared off the retrievable tool 50, as the retrievable tool 50 passes through the shearing tool 30.

FIG. 3A shows the third set of fins 56 having been sheared, already, as these fins protrude less and no longer contact the interior of the drill string 20. Once the entire length of the retrievable tool 50 has passed through the shearing tool 30 and each set of fins has been sheared, trimmed, or reduced, the retrievable tool will then be able to pass through any restrictions in the drill string on its way to the surface.

Figure 4:
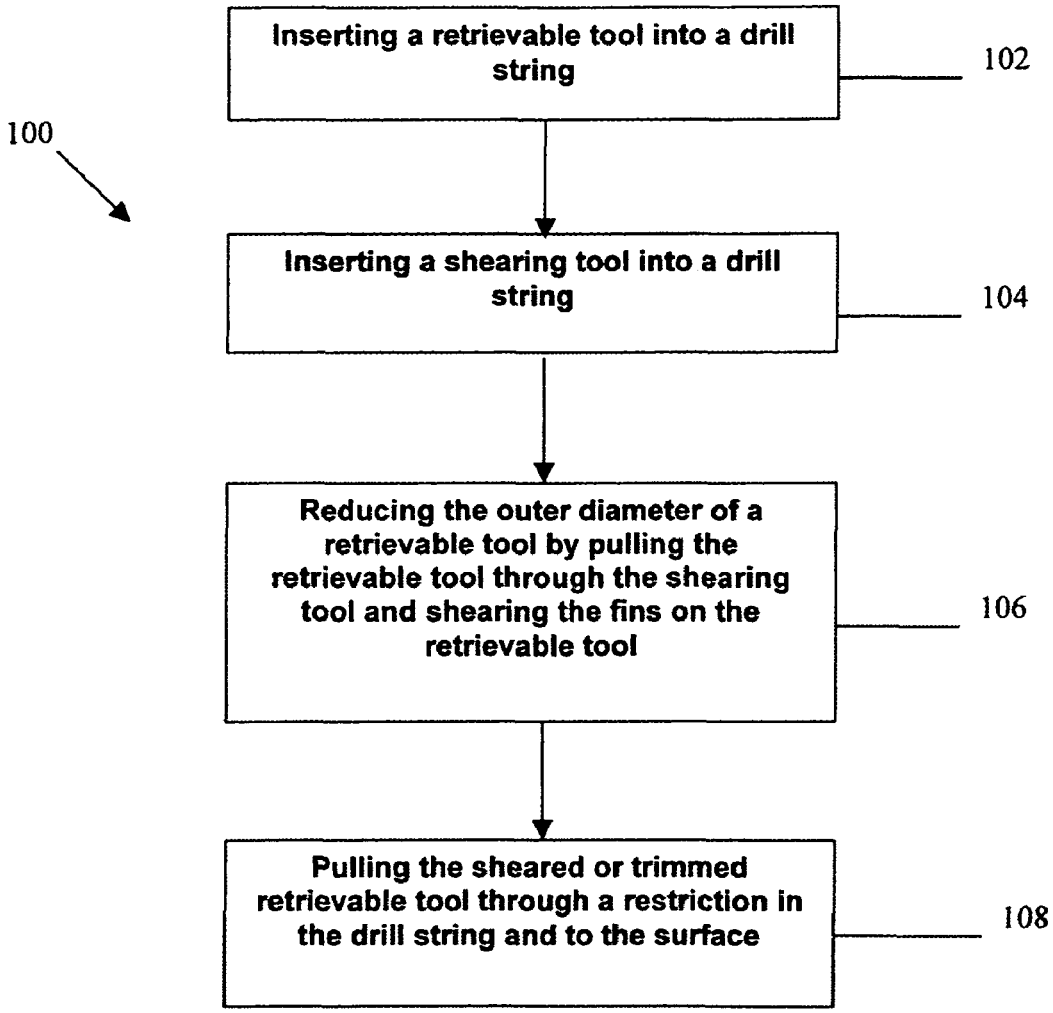
FIG. 4 depicts a flow chart of an embodiment of a method of using a shearing tool for removing a retrievable tool from a drill string.

FIG. 4 depicts a flow chart of a method 100, in accordance with an embodiment of the present invention. Step 102 includes inserting a retrievable tool into the drill string, and Step 104 includes inserting the shearing tool into the drill string. While many retrievable tools are near to, or inserted into, the drill collar of the drill string, the current method can include inserting the retrievable tool anywhere in a drill string. The shearing tool can be inserted above the retrievable tool in the drill string to ensure the retrievable tool passes through the shearing tool. The shearing tool can be located between the retrievable tool and any reductions or restrictions on the interior diameter of the drill pipe in order to reduce the diameter of the fins on the retrievable tool before the retrievable tool reaches any such reduction or restriction in diameter.

Step 106 of the method includes the shearing tool shearing, trimming, or reducing the outer diameter of the fins on the retrievable tool as the retrievable tool passes through the shearing tool, as described with respect to FIGS. 3A and 3B. This takes place at some point between the drill collar and some restriction in the interior diameter of the drill string. Step 108 of the method includes pulling the retrievable tool with sheared, reduced, and or trimmed fins, through any pipe restrictions in the drill string and to the surface.

Figure 5:
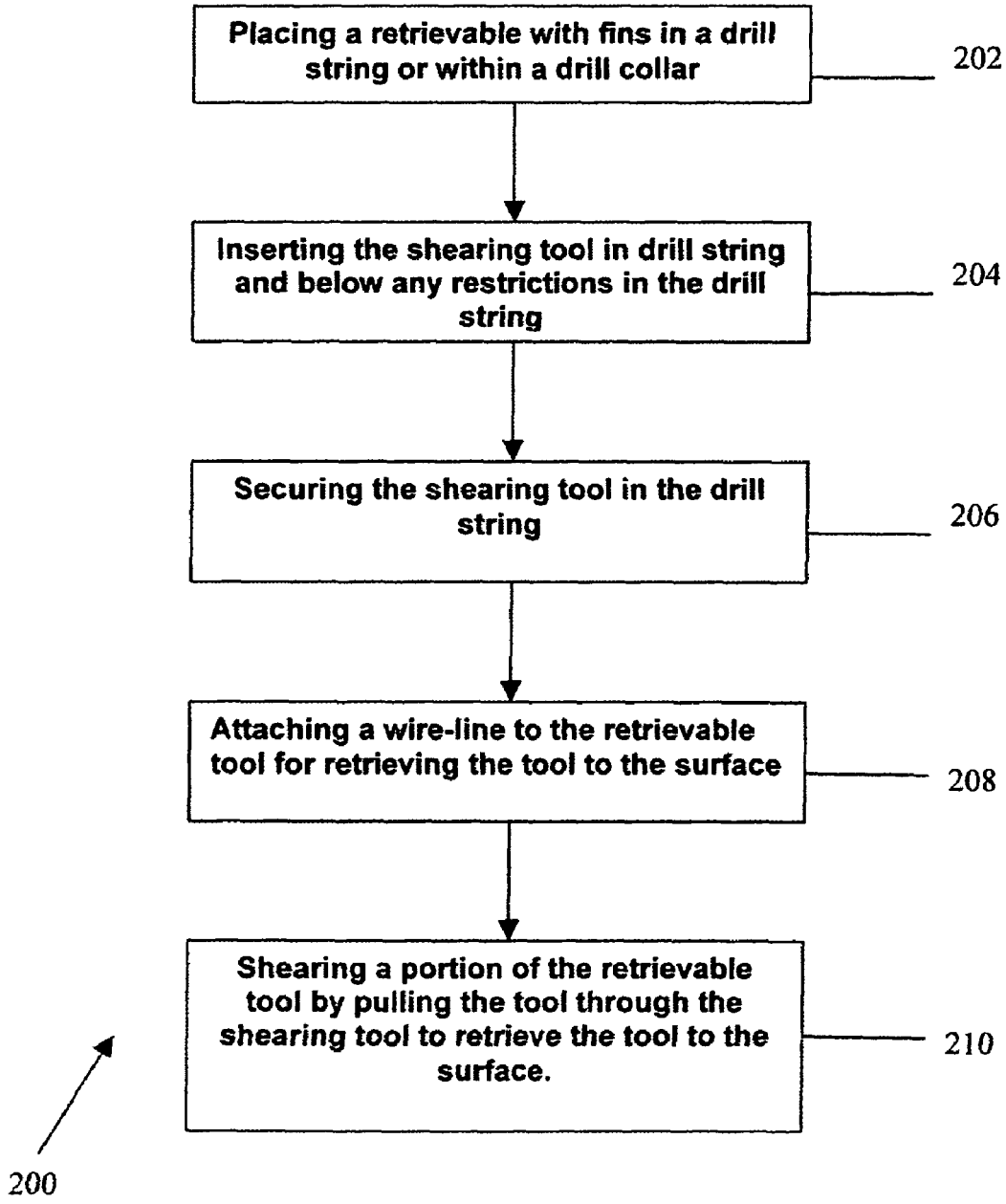
FIG. 5 depicts a flow chart of an embodiment of a method of using a shearing tool for retrieving a downhole tool comprising fins from a drill string.

FIG. 5 depicts a method according to an embodiment of the present invention. A method of removing a retrievable tool with fins is designated at 200. The steps of the method include placing the retrievable tool with stabilizing or centralizing fins in or near the drill string or in or near the drill collar of the drill string, Step 202. In one embodiment of the method, the retrievable tool can be placed in the drill collar at the surface and then the drill string is made up in the typical fashion as the drill bit and the drill collar are lowered into the wellbore.

The steps of the method can continue with inserting the shearing tool below any restrictions in the drill string, which can include placing the shearing tool in the box end of a first joint or sub of the drill string, Step 204. The insertable shearing tool can be placed in any section of drill pipe or sub, at an appropriately sized box end, but the shearing tool must be placed downhole of any jars or other reductions in the interior diameter of the drill string to ensure that the retrievable tool can pass through the shearing tool prior to any restrictions in the drill string in order to be retrieved from the drill string.

Step 206 of the method includes securing the shearing tool in the drill string, which can include stabbing the first section of drill pipe or a sub with a pin end of a second section of drill pipe or sub. In this way, the shearing tool can be firmly secured within the first section of drill pipe or sub and fixed in a position relative to the drill collar and drill bit, as the drill string continues to lower.

Step 208 includes the retrievable tool, such as a MWD tool or other downhole tool, being retrieved through the drill string, by attaching and using a wire-line. By tensioning the wire-line, the retrievable tool begins to work its way back up the drill string.

Step 210 includes the retrievable tool reaching the shearing tool and the shearing of the fins on the retrievable tool to allow the retrievable tool to move through the drilling string and to the surface. As the retrievable tool is pulled through the shearing tool, the fins are sheared, trimmed, and/or reduced by the cutting edge of the shearing tool, as previously described herein. Then, the reduced retrievable tool can pass easily through jars and other reductions in the drill string on its way to the surface.

The apparatus and methods of certain embodiments of the present invention generally operate by placing a retrievable tool 50 in the drill collar 22 of a drill string 20. Although, the retrievable tool can be placed elsewhere in the drill string, including but not limited to subs in the drill string 20, that are designed to accommodate retrievable tools 50. The retrievable tool 50 can comprise a plurality of fins as previously described for firmly centralizing the retrievable tool 50 in the drill collar 22 and for reducing the shock and vibration on the retrievable tool 50. As the drill string is lowered in the borehole 16, and sections of pipe are added to the drill string 20, the shearing tool 30 can be inserted in or at the box end 26 of a first section of drill pipe. The pin end 28 of a second joint of drill pipe or sub 27 is threaded into the box end 26 of the first section of drill pipe, locking the shearing tool 30 in place in the drill string 20. The shearing tool 30 can be inserted between any two joints or subs with the appropriate box and pin configurations. The only requirement regarding placement of the shearing tool is that the shearing tool is inserted before any jars 14 or other subs, with reduced interior diameters, so that the shearing tool 50 is downhole of any restriction or sub of the drill string 20.

Once the retrievable tool 50 and the shearing tool 30 are in place, drilling operations continue as they normally would until such time as it becomes desirable to retrieve the retrievable tool(s) 50. There can be several reasons for retrieving a retrievable tool 50. For example, the tool itself may not be functioning correctly, or the bit or the drill string 20 may be stuck. In order to remove the retrievable tool 50 through certain portions of the drill string 20, a wire-line is run through the drill string 20 and connected to the retrievable tool 50. The wire-line pulls the retrievable tool 50 to the surface 16.

The body of the retrievable tool 50 is generally constructed from a cylindrical metal tubing or a plurality of cylindrical metal tubings. The body's cylindrical shape will have a diameter less than the channel 40 in the shearing tool 30, so that the retrievable tool 50 will initially pass through the shearing tool 30 without impediment. However, when each set of the fins reach the cutting surface 48 of the shearing tool 30, their outer diameter can extend or exceed the diameter of the channel 40 of the shearing tool 30. Since the shearing tool 30 is firmly locked in place, the wire-line can be tensioned to about 80-100 pounds or more so that the cutting surface 48 of the shearing tool 30 will begin to shear portions of the fins from the retrievable tool 50, as the retrievable tool 50 is pulled through the shearing tool 30, thereby reducing the outer diameter of the fins and, thus, the retrievable tool 50. Once each set of fins has passed through the shearing tool 30, the retrievable tool 50 will have a sufficiently small outer diameter to pass through any restrictions or reductions in the interior diameter of the drill pipe 20 on its way to the surface 16 After passing through the shearing tool 30, the retrievable tool can be wire-lined to the surface in the typical manner.

It will be understood that such terms as "up," "down," "vertical," "top," "bottom," and the like, are made with reference to the drawings and/or the earth and that the devices may not be arranged in such positions at all times depending on variations in operation, transportation, and the like. As well, the drawings are intended to describe the concepts of the invention so that the presently preferred embodiments of the invention will be plainly disclosed to one of skill in the art, but are not intended to be manufacturing level drawings or renditions of final products and may include simplified conceptual views as desired for easier and quicker understanding or explanation of the invention. As well, the relative size of the components may be greatly different from that shown.

The foregoing disclosure and description of the invention is illustrative and explanatory thereof, and it will be appreciated by those skilled in the art, that various changes in the size, shape and materials, the use of mechanical equivalents, as well as in the details of the illustrated construction or combinations of features of the various elements may be made without departing from the spirit of the invention. While the embodiments of the invention have been described with emphasis on the embodiments, it should be understood that within the scope of the appended claims, the embodiments might be practiced other than as specifically described herein.

The invention claimed is:

1. A system for reducing the outer diameter of objects disposed in a tubular string, the system comprising:

a restriction in the tubular string having a first diameter;

a downhole tool having a second diameter greater than the first diameter;

a shearing tool comprising a body having a first end, a second end, and a channel, wherein the first end engages a joint of the tubular string, wherein the second end protrudes into a flow path of the tubular string for shearing materials pulled through the channel, and wherein pulling the downhole tool through the channel provides the downhole tool with a third diameter less than the second diameter.

2. The system of claim 1, wherein the downhole tool comprises a compressible portion, wherein compression of the compressible portion reduces the third diameter to a fourth diameter less than or equal to the first diameter for enabling the downhole tool to pass through the restriction.

3. The system of claim 1, wherein the third diameter is less than or equal to the first diameter such that the downhole tool can pass through the restriction.

4. The system of claim 1, wherein the downhole tool comprises a protruding portion that provides the downhole tool with the second diameter, wherein the protruding portion contacts an interior surface of the tubular string for positioning the downhole tool relative to the tubular string.

5. The system of claim 4, wherein the protruding portion comprises at least one fin for centralizing the downhole tool in the flow path of the tubular string, wherein said at least one fin comprises a sharable material, and wherein pulling the downhole tool through the channel shears said at least one fin to provide the downhole tool with the third diameter.

6. The system of claim 1, wherein the second end comprises at least one blade disposed thereon for shearing a portion of the downhole tool to provide the downhole tool with the third diameter.

7. The system of claim 1, wherein the shearing tool further comprises a protruding portion secured within the joint to retain the shearing tool at a selected position within the tubular string.

8. The system of claim 7, wherein the joint comprises a box portion, and wherein the shearing tool is secured within the box portion.

9. A method for retrieving a downhole tool from a tubular string, the method comprising the steps of:

providing a downhole tool into a tubular string having a restriction therein;

providing a shearing tool into the tubular string at a position between the downhole tool and the restriction; and moving the downhole tool into contact with the shearing tool, wherein contact between the shearing tool and the downhole tool provides the downhole tool with a reduced diameter.

10. The method of claim 9, further comprising the step of moving the downhole tool through the restriction.

11. The method of claim 10, wherein the step of moving the downhole tool through the restriction comprises compressing a compressible portion of the downhole tool to further reduce the diameter of the downhole tool for enabling the downhole tool to pass through the restriction.

12. The method of claim 9, wherein the step of moving the downhole tool into contact with the shearing tool provides the downhole tool with a diameter less than or equal to a diameter of the restriction.

13. The method of claim 9, wherein the step of providing the downhole tool into a tubular string comprises contacting an interior surface of the tubular string with a protruding portion of the downhole tool for positioning the downhole tool relative to the tubular string.

14. The method of claim 13, wherein the protruding portion comprises at least one fin for centralizing the downhole tool, wherein said at least one fin comprises a sharable material, and wherein the step of moving the downhole tool into contact with the shearing tool shears said at least one fin to provide the downhole tool with the reduced diameter.

15. The method of claim 9, wherein the step of moving the downhole tool into contact with the shearing tool comprises shearing a portion of the downhole tool using at least one blade disposed on the shearing tool.

16. The method of claim 9, wherein the step of providing the shearing tool into the tubular string comprises engaging a protruding portion of the shearing tool within a joint of the tubular string to retain the shearing tool at a selected position within the tubular string.

* * * * *